US007192091B1

(12) United States Patent
Ping Sheng

(10) Patent No.: US 7,192,091 B1
(45) Date of Patent: Mar. 20, 2007

(54) FOLDING SLING CHAIR

(75) Inventor: Wang Ping Sheng, Kowloon (CN)

(73) Assignee: Agio International Company Limited, Hong Kong (HK)

( * ) Notice: Subject to any disclaimer, the term of this patent is extended or adjusted under 35 U.S.C. 154(b) by 0 days.

(21) Appl. No.: 11/436,973

(22) Filed: May 17, 2006

(51) Int. Cl.
*A47C 1/00* (2006.01)
*A47C 7/02* (2006.01)

(52) U.S. Cl. ..... 297/378.1; 297/452.2

(58) Field of Classification Search ..... 297/378.1, 297/16.1, 452.2
See application file for complete search history.

(56) References Cited

U.S. PATENT DOCUMENTS 1,687,271 A * 10/1928 Soss ..... 16/358
3,978,549 A 9/1976 Vitt
4,089,084 A 5/1978 Droz
4,146,269 A 3/1979 Beckley
4,241,950 A 12/1980 Simpson
4,252,367 A 2/1981 Vanderminden
4,252,371 A 2/1981 Lehnen
4,351,562 A * 9/1982 Twitchell et al. ..... 297/344.17
4,613,185 A 9/1986 Marchesini
4,817,241 A 4/1989 Koch et al.
4,838,608 A 6/1989 Hansen-Smith et al.
4,865,387 A * 9/1989 Lipparini et al. ..... 297/378.1
4,889,383 A * 12/1989 Jones ..... 297/16.1
5,054,848 A 10/1991 Liu
5,056,804 A 10/1991 Wilson et al.
5,110,180 A 5/1992 Schneider
5,415,455 A 5/1995 Geldbaugh
5,429,413 A 7/1995 Levy et al.
5,476,308 A 12/1995 St. Germain
5,536,063 A 7/1996 Cable
5,624,153 A 4/1997 Censullo, Jr.
5,915,782 A 6/1999 Geldbaugh
5,931,526 A 8/1999 Tseng
5,961,178 A 10/1999 Hodson
6,116,682 A 9/2000 Baur
6,257,660 B1 7/2001 Calvey
6,293,624 B1 9/2001 Gaylord et al.
6,487,755 B1 12/2002 Caldari
6,540,290 B2 4/2003 Liu
6,585,323 B2 7/2003 Gaylord et al.
6,669,280 B1 12/2003 Wegner
6,896,327 B1 5/2005 Barile, Sr.

* cited by examiner

*Primary Examiner*—Milton Nelson, Jr.
(74) *Attorney, Agent, or Firm*—Williams Mullen; M. Bruce Harper

(57) ABSTRACT

A folding sling chair is provided in which members of the chair frame incorporate internally mounted hinges, preferably invisible hinges. When an invisible hinge is in a neutral or stop position, only a seam or dividing line is visible; the internally mounted hinge structure is invisible. In operation, the hinge structure of the invisible hinge is less likely to interfere with a pliable fabric sling than in conventional designs. For example, the side rails of a seat of a folding sling chair may fold at invisible hinges mounted internally within the side rails, which can be angled to create an adjustable backrest. Various other applications of the present invention include angled and adjustable foot rests, head rests, chaise lounge arrangements, folding task chairs, etc.

12 Claims, 8 Drawing Sheets

FOLDING SLING CHAIR

BACKGROUND OF THE INVENTION

1. Field of the Invention

The present invention relates to sling chairs, and more particularly to folding sling chairs.

2. Background

Informal, occasional use furniture has become quite popular. Manufacturers are increasingly called upon to offer comfortable, practical, and stylish products. Frequently, consumers desire this furniture to be capable of being stored during inclement weather or when out of season. Accordingly, there is a significant and growing market for occasional use furniture having hinges or pivots so that it can be folded and stored.

A hinge or pivot is a device that connects two members and permits some sort of rotation or pivot between the members. Hinges have long been useful in the construction of a wide variety of furniture, most commonly for mounting access covers such as desk tops or cabinet doors, or for foldable extensions, such as the leaves of tables. Hinges or pivots have also been used in chairs where a portion of the chair structure may fold or rotate. Folding chairs are useful in that when they are no longer needed, the chair may be folded into a smaller volume and stored.

A sling chair is a type of chair in which all or a portion of the chair's seat or backrest, known in the field as the "sling," is sustained in suspension. A subset of sling chairs include folding chairs that have slings made of a pliable material such as a woven fabric or mesh of natural or manmade material forming the back and/or seat that is suspended by a portion of the chair frame. Because of the use of a suspended sling, folding sling chairs may be light weight and easy to store. Further, sling chairs do not require cushions as the sling is generally sufficiently pliable for sitting comfort. Thus, the fabric sling provides comfortable surfaces that are easily cleaned and cool in hotter weather.

The sling panel or panels fastened to the chair frame in order to suspend it in place and bear the weight of the sitting individual. One typical way of fastening is a stitched or woven loop forming a sleeve or channel along opposing edges of the sling into which frame members may be inserted so that the sling may be suspended. Alternatively, dowels may be inserted into the sleeve after the sleeve has been inserted into a slotted keyway within a seat member. The dowel typically has a diameter greater than keyway width, thereby restraining the sling. In either case, the sling may be suspended or supported by the frame to serve as a seat, backrest, or both, and may be under tension, depending on the application.

For a folding sling chair, the design of the seat and back must accommodate or be adaptable to the change in chair frame geometry when the chair is folded. If not, the sling may interfere with the folding process, be creased or otherwise damaged when folded. In some conventional examples, the sling may have to be removed from the frame for folding, adding complexity and the requirement to store the sling separately from the frame. A folding backrest is a common example where this issue can arise.

Accordingly, folding sling chairs have fallen into several rough categories. One category of conventional folding sling chairs involves a side X-frame that scissors longitudinally about a transverse axis, an example of which may be seen in FIG. 2. When folded or pivoted about hinge 38, the frame members 32 operate as a scissor, such that upper portions of frame members 32 (acting as backrest and seat support) are brought together on top, while lower portions of frame members 32 (acting as the legs) are brought together below. When unfolded, the lower portions of frame members 32 spread out for stability. Cross members 34 often do not fold in this design, and this design typically lacks side rails about the seat or back. Therefore, this design of folding sling chairs suspends the sling panel from a lower front cross member and an elevated rear cross member. When this sling chair 30 is unfolded and set up, the sling 36 hangs in a dipping effect between the cross members 34, thereby forming a catenary that permits casual seating. The elevated rear cross member creates a form of backrest. This type of folding sling chair is often used on beaches or around pools. Although this simple design uses a single piece of fabric that need not be removed for folding, it has several drawbacks. The dipping design of sling 36 is necessary for stability during seating, but it elevates the front and can pressure the popliteal area of the leg. In addition, scissor chair 30 can be uncomfortable because the weight of the individual is focused largely on the seat area. As a design limitation, the cross members 34 must be sufficiently strong to carry the entire weight of the individual. Some efforts to address these problems have involved adding members to frame members 32 or extending frame members 32 to accomplish new support functions. Other efforts add fabric pieces to provide support to sling 36 to distribute the weight, with a significant loss of simplicity in frame design and sometimes loss of the simplicity of a single piece design for sling 36.

A second category of conventional folding sling chairs has a sling seat and backrest where portions of the sling that might interfere with operation of the hinge are omitted. An example of this type is chair 40 shown as a lawn chair in FIG. 3A. This approach enables a variety of frame designs, but increases the complexity of the sling or fabric panel design. A difference of this approach over sling chair 30 is that sling 46 may be suspended by frame members 42 in addition to cross members 44. Without the need for a catenary, sling 46 may be drawn more tightly across the frame for a more even distribution of weight. In many cases, as shown, sling 46 includes cutouts 47 in the vicinity of hinges 48 to avoid fabric wear on the sling or entanglement with hinges 48. In addition, exposed hinges 48 produce a cluttered, utilitarian element that detracts from the architectural appearance of the chair. In other cases, as shown in FIG. 3B, chair 40 may use multiple pieces of fabric (e.g., sling 46 split into sling fabric panels 461 and 462). Dividing sling 46 into multiple pieces means that gap 43 may be provided at the pivoting axis for hinge 48, so that sling 46 does not interfere with hinge 48 or the folding action. In general, the greater the number of hinges 48 (i.e., pivoting or folding portions), the greater the number of pieces of sling 46. For both of these designs, the structure of hinge 48 can complicate or block the mounting of the sling 46. In addition, a primary drawback of these designs is the greater complexity and inconvenience of multiple fabric pieces (e.g., sling fabric panels 461 and 462 in FIG. 3B), cutouts (e.g., cutout 47 in FIG. 3A), or open fabric gaps (e.g., gap 43 in FIG. 3B) located near hinges or pivot lines. This complexity can pose problems for assembly, convenience of use, or inter-operability of the fabric pieces.

The exposed hinge structure can have other drawbacks. Depending on the design, an individual or their garments may be pinched by a hinge when it is pivoted. This problem can also arise in the case of folding a sling chair with X-shaped scissor hinges. With a scissor hinge, the longitudinal frame members do not lie in the same plane. As the adjacent but pivoting members scissor, they can easily trap and pull loose garments or cloth into the space between the members. Aside from problems during operation, an exposed hinge butt can also scratch individuals or protrude into the sitting space. Further, the use of exposed hinges in higher end products can be unsightly and impair the integrity of an aesthetic design.

Accordingly, there is a need for folding sling chairs that offer simplicity and safety in fabric sling and hinge design in order to reduce fabric wear of the sling, user discomfort, risk of pinching injury, and the expense of construction. The simple scissor arrangement does not provide effective side support nor fully addresses the problem of hinge interference. More complicated approaches solve some problems, but introduce difficulties in manufacture and expense. Therefore, the conventional categories of design do not offer a folding sling chair having single piece of fully supported sling that is free from the problems of exposed hinges.

BRIEF SUMMARY OF THE INVENTION

The present invention is a folding sling chair frame in which the disadvantages of conventional designs are minimized by use of hinges mounted internally within chair frame members. This novel approach avoids the complications that are presented by the hinge structure of prior folding chairs. In particular, the present invention is capable of having a pliable sling that is a single piece of fabric mounted onto side rails without special adaptation or cutout of the fabric. Further, the internal mounting of the hinge produces a more uniform surface for the frame of the chair.

Briefly, the present invention overcomes the limitations of past approaches to folding chairs, and folding sling chairs in particular, by using hinges that do not alter the exterior structural profile of the chair frame. The present invention is a folding sling chair in which the chair frame incorporates internally mounted hinges, preferably "invisible" hinges. For example, a form of invisible hinge is disclosed in U.S. Pat. No. 1,687,271 to J. Soss, which is incorporated by reference. Invisible hinges have been internally mounted in doors and access covers for desks or cabinets. However, they have not been used in foldable sling chairs as claimed in the present invention. When such an invisible hinge is in a neutral or stop position, only a seam or dividing line is visible; the internally mounted hinge structure is invisible.

The particular configuration of a sling chair can vary, depending on the overall design and application of the embodiment. For example, the side rails of a folding chair may fold at invisible hinges mounted internally within the side rails, which can create an adjustable backrest. In one embodiment, the side rails of a chair may be fashioned to support a fabric panel sling or seating member as described in U.S. Pat. Nos. 6,293,624 and 6,585,323 to Gaylord et al., which are hereby incorporated by reference. In such an embodiment, the side rails may include a keyhole slot extending along the side rail, as disclosed in the referenced patents, except where the invisible hinge is mounted. The fabric panel sling or seating member may be retained within the slots using fabric loops and dowels or rods for inserting into the loops for each side rail. Cross members span and space apart the side rails to suspend the sling and draw it tight. Variations in this structural design could provide an angled and adjustable back or footrest, head rest, chaise lounge arrangements, folding task chairs, etc., as will be apparent for those skilled in the art. Further, other attachment technologies and frame configurations known in the field will also work.

In another embodiment, the side rails may be tubular and the seating member may be a sling or fabric panel having sleeves that are adapted to receive portions of the side rails or parallel members. Because the invisible hinge presents no surface structure, such a sleeve may be readily drawn over large lengths of the tubular side rails, enabling the sling to be fashioned of a single piece. Similarly, embodiments having fasteners along the side rail margins of the sling may be used where the sling is folded over the side rails, including the area where the invisible hinge is mounted, and then fastened, optionally to a mating fastener on the sling. Such fasteners may be hook and loop, buttons, zippers, etc. In such embodiments, the sling need not be so tightly fitting onto the rails as to contract into the gap presented by the butting portions of the side rails when the hinge is opened. However, as the obverse side retracts when an invisible hinge pivot is closed, then the stress on the reverse side will be lessened. Even if there were any bunching or pinching of sling fabric, it would occur on the reverse side.

In some cases, an invisible hinge may be used to provide other folding features to the structure of chairs. For example, an invisible hinge may be used to pivotally mount a moveable arm rest. Such a folding arm rest member may be hinged near the back of the chair for improved clearance when the arm rest is folded out of the way.

DETAILED DESCRIPTION OF THE INVENTION

The following detailed description is not to be taken in a limiting sense, but is made merely for the purpose of illustrating general principles of embodiments of the invention.

As introduced above, the present invention is a folding sling chair in which the chair frame members incorporate internally mounted hinges, preferably invisible hinges. Invisible hinges may be mounted within the cross section of tubular members to add features over conventional folding sling chair frames.

Figure 1:
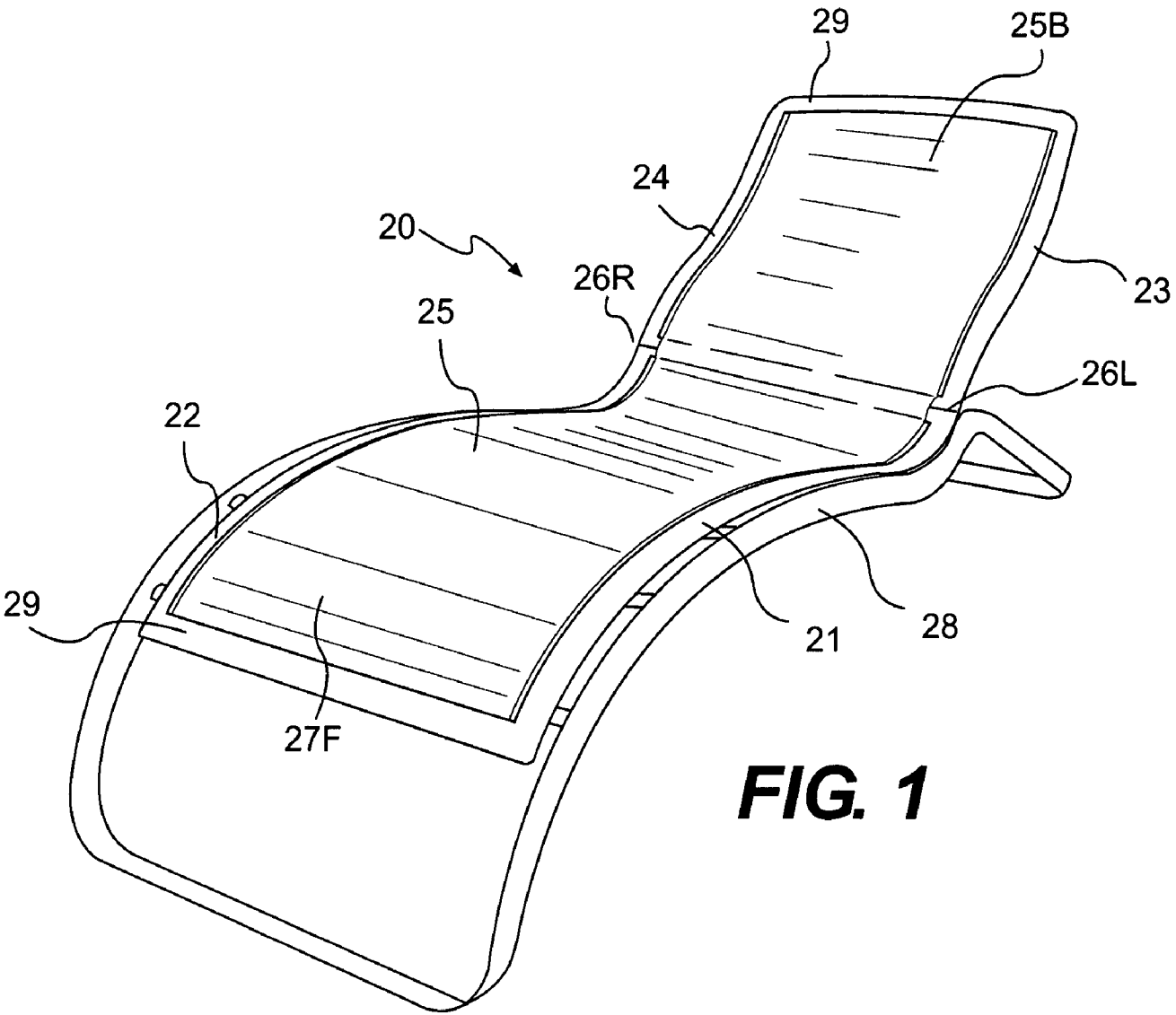
FIG. 1 shows an example of an embodiment of the invention.

With reference to the drawings, an example of the present invention is shown in FIG. 1. Folding sling chair 20 in this example is a simple chaise lounge embodiment. Two left side rails 21 and 23 are tubular members supporting the left side of sling 25, such as a pliable fabric panel. The mounting of sling 25 for this embodiment is somewhat similar to that disclosed in '624 and '323 to Gaylord et al. However, a wide variety of mounting arrangements will work with the present invention, as will be apparent to those of ordinary skill in the art. Notably, left invisible hinge 26L is closed and therefore is visible only as a seam between the two left side rails 21 and 23. However, it may be appreciated from this perspective that rear left side rail 23 may pivot with respect to front left side rail 21. Similarly, two right side rails 22 and 24 support the right side of sling 25, and rear right side rail 24 may pivot with respect to front right side rail 22. Together, side rails 21–24, when assembled with transverse members 29, form a supporting seating zone for an individual to sit or recline. In this way, the fabric of sling back area 25B (i.e., a seat back) may pivot with respect to fabric of sling front area 25F (i.e., a seat.) Support may be provided from approximately 360 degrees around the seating zone, or from merely a desired portion thereof.

Base assembly 28 supports folding sling chair 20 and, for this embodiment, comprises four curvilinear tubes that depend downwardly at the ends. As shown, base assembly 28 directly supports a fixed portion of sling 25 through fixed (i.e., front) side rails 21 and 22 and indirectly supports a pivoting portion of sling 25 through invisible hinges 26L and 26R. Transverse members 29 are disposed between, attach to, and structurally maintain left side rails 21 and 23 in a fixed and opposing orientation from right side rails 22 and 24. Of course, transverse members 29 may be configured as disclosed in '624 and '323 to Gaylord et al., or alternatively as a simple tubular piece in which the hollow of the piece mounts onto or receives a protruding lug, fastener, etc. (not shown), as known in the art. As noted above, transverse members 29 may support sling 25 or simply fill a structural function in maintaining side rails 21–24 in opposing disposition. In some embodiments, the structural function of one of transverse members 29 may be integrated into a portion of base assembly 28; those skilled in the art will see that base assembly 28 may be designed to integrate transverse structure that separates and maintains side rails 21 and 22 in a fixed and opposing orientation. In that case, only one discrete transverse member 29 in the form shown in FIG. 1 would be present, located on the pivoting portion of sling 25, or fabric of sling back area 25B. Accordingly, transverse member 29 should expressly be construed to encompass such hybrid function for base assembly 28 in those cases where base assembly 28 provides transverse, separating structure maintaining side rails 21 and 22 in a fixed and opposing orientation. In addition to the example of curvilinear tubes shown in FIG. 1, those in the field will recognize that a wide variety of other designs (not shown) for base assembly 28 are available, including by way of example four or more simple and discrete legs depending from non-pivoting front side rails 21 and 22, a single pedestal, telescoping members, skid like members, one or more wheeled supports, etc. In addition, a variety of backrest support 281 (not shown) known in the art may be used to support the fabric backrest portion of sling 25B as it is pivoted or adjusted about invisible hinges 26.

Figure 2:
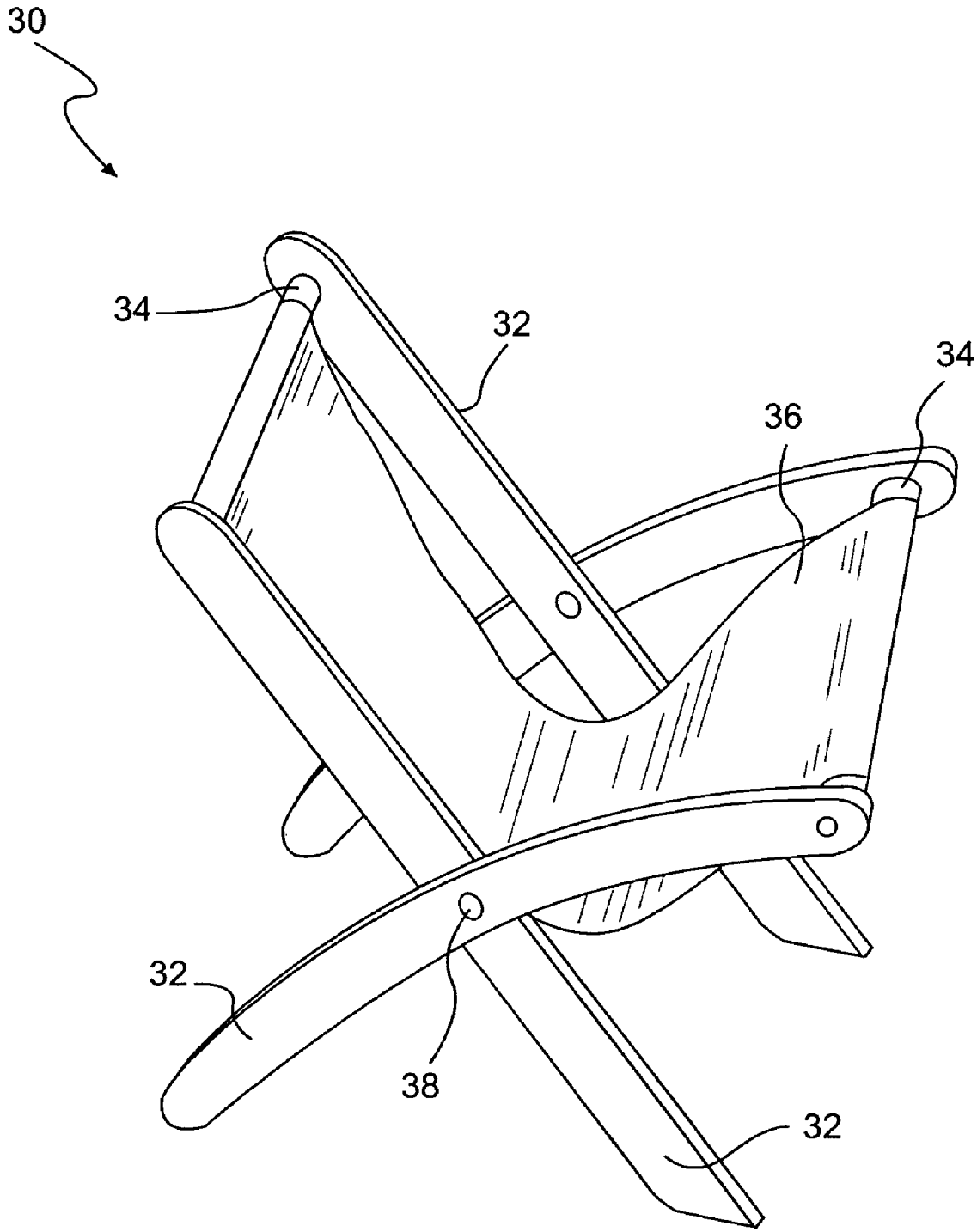
FIG. 2 PRIOR ART
FIG. 2 is a scissor frame sling chair of the prior art.
Figure 3A:
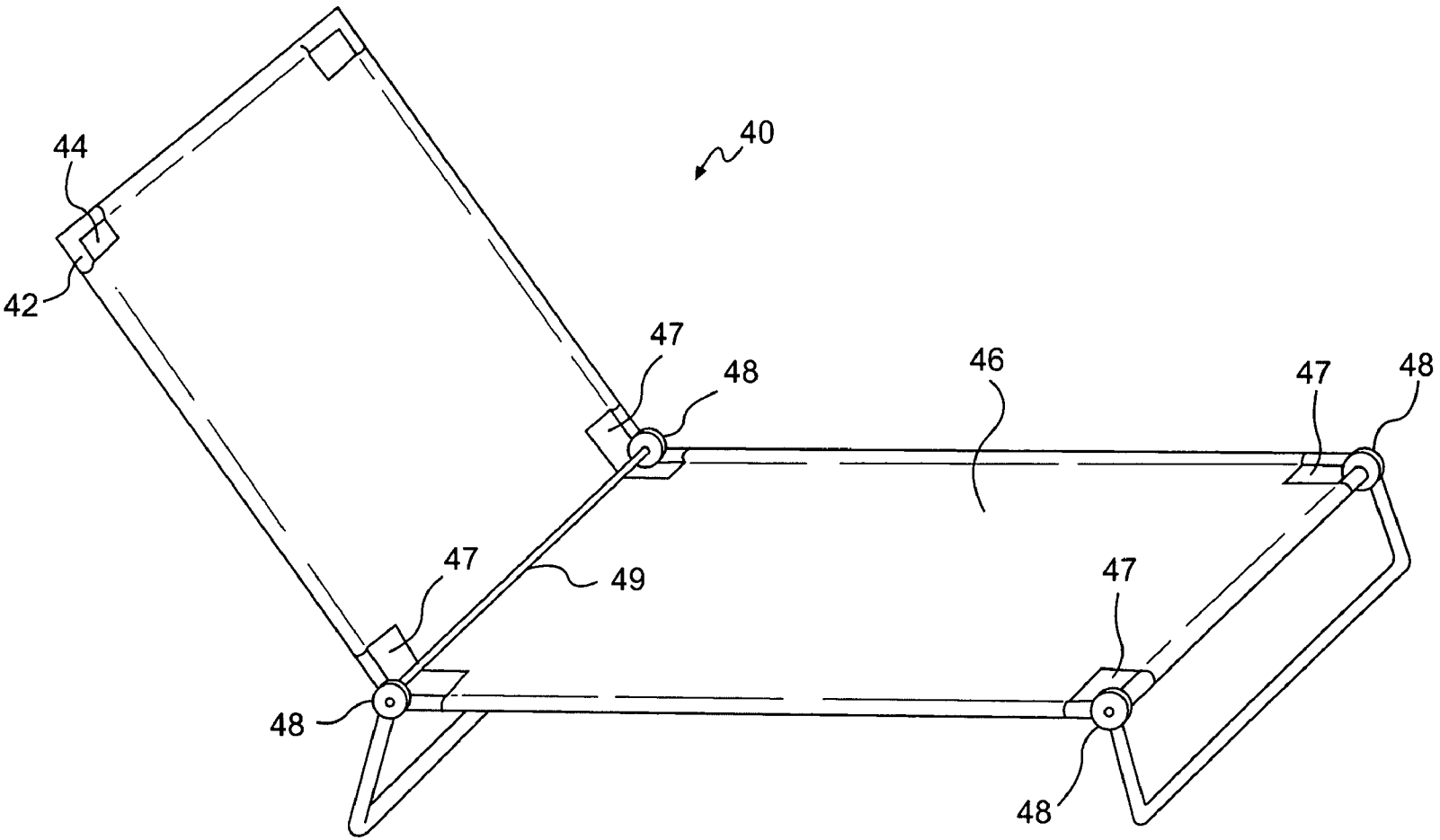
FIG. 3A PRIOR ART
FIG. 3A is an example of a sling chair of the prior art having cutouts in the sling fabric near hinges.
Figure 3B:
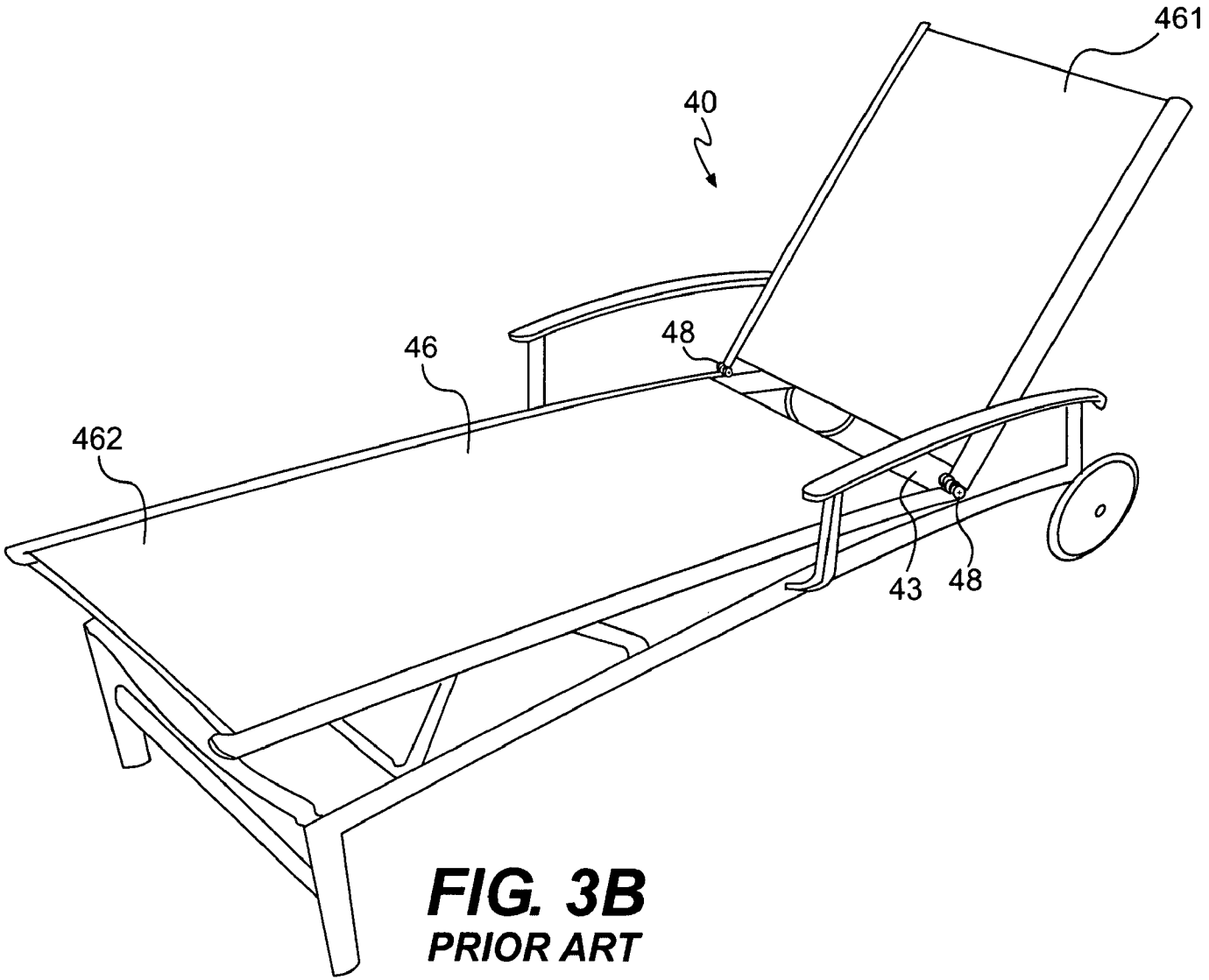
FIG. 3B PRIOR ART
FIG. 3B is an example of a sling chair of the prior art having a sling with multiple fabric pieces.

For purpose of contrast, FIGS. 2, 3A, and 3B, which were discussed above, show examples of conventional folding sling chairs.

Figure 4A:
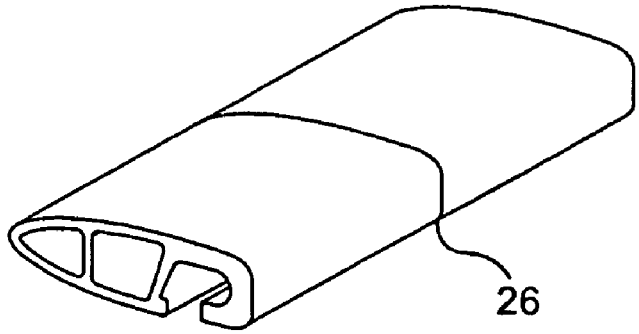
FIG. 4A shows an invisible hinge in the closed position.
Figure 4B:
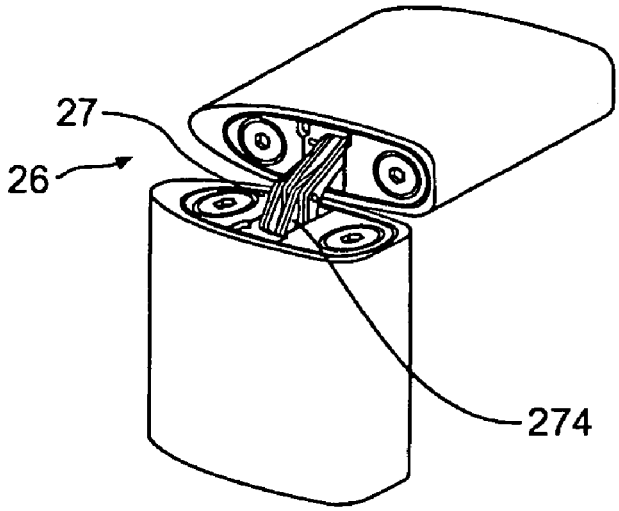
FIG. 4B shows an invisible hinge opened to a 90 degree angle, as seen from the reverse side.
Figure 4C:
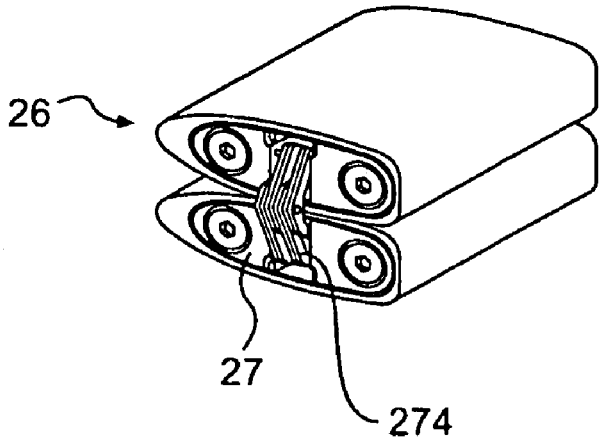
FIG. 4C shows an invisible hinge opened to a 180 degree angle.
Figure 5:
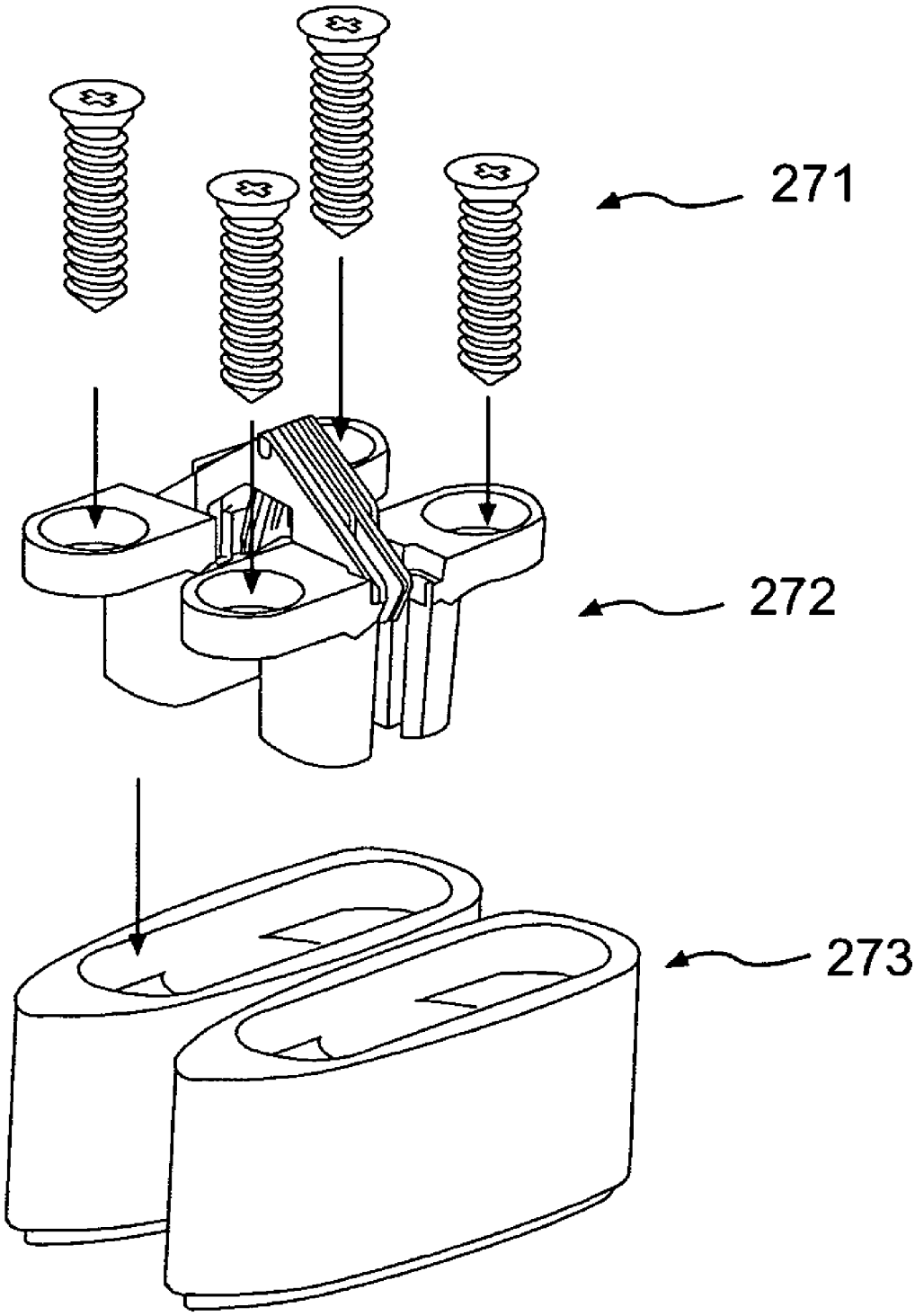
FIG. 5 shows the components for installation of an invisible hinge.

FIGS. 4A through 4C show from the reverse, or rear perspective, the operation of invisible hinge 26 at different angles of pivot. FIG. 4A depicts a closed or 0-degree angle of pivot, and only a seam of invisible hinge 26 is visible, none of hinge structure 27 is visible. FIG. 4B depicts a 90-degree angle of pivot, where a portion of hinge structure 27 is visible. FIG. 4C depicts the full or 180-degree angle of pivot, so that hinge structure 27 is fully extended and most is visible. FIG. 5 shows an embodiment of the components of hinge structure 27, where fasteners 271 attach hinge mechanism 272 to connecting tube 273, which is then mated into a cross section of side rails 21–24, connecting and interposed between the respective rails, or other frame member depending on the desired folding portion.

For the present invention, frame members are preferably tubular, such as side rails 21–24, at the point of invisible hinge 26 so that invisible hinge 26 may mate with or be recessed into the tubular structure. Of course, apart from portions of the frame members at the point of invisible hinge 26, the frame members may be of a wide variety of cross sections or shapes, or even solid, as is known in the art. That is, the frame member cross section need not be solely circular, elliptical, or consistently tubular. The cross section profile may vary over the length of the frame member or side rails 21–24. Preferably, however, the cross section of the frame member will provide sufficient area at the vicinity of invisible hinge 26 to enable internal mounting, as with a tube. Thus, tubular for the members of the present invention means having sufficient internal volume to permit the internal mounting of invisible hinge 26. Preferably, but not necessarily, the frame members may be somewhat hollow for lighter weight.

Pivoting two frame members about an invisible hinge 26 initially opens the hinge to the reverse side. In some cases, the frame and hinge may be oriented so that one frame member may be rotated or folded fully onto the other member, at which point the hinge structure is exposed or visible to the obverse side. An invisible hinge 26 is clearly advantageous from an aesthetic perspective. The tubular frame exterior may take a wide variety of design forms in which the hinge structure is not an issue; the hinge is only visible when the frame member is folded into a storage position. In addition, the design of invisible hinge 26 provides a track or groove in blank 274 of the hinge that defines the relative motion of the frame members during pivoting. Unlike conventional hinges, this track may be adapted to the shape of the frame members, and to minimize situations in which a fabric piece or occupant might be pinched. Those skilled in the art will readily see how invisible hinge 26 may be adapted for use with other tubular frame members, such as an arm rest member (not shown) hinged for folding out of the way.

Figure 6:
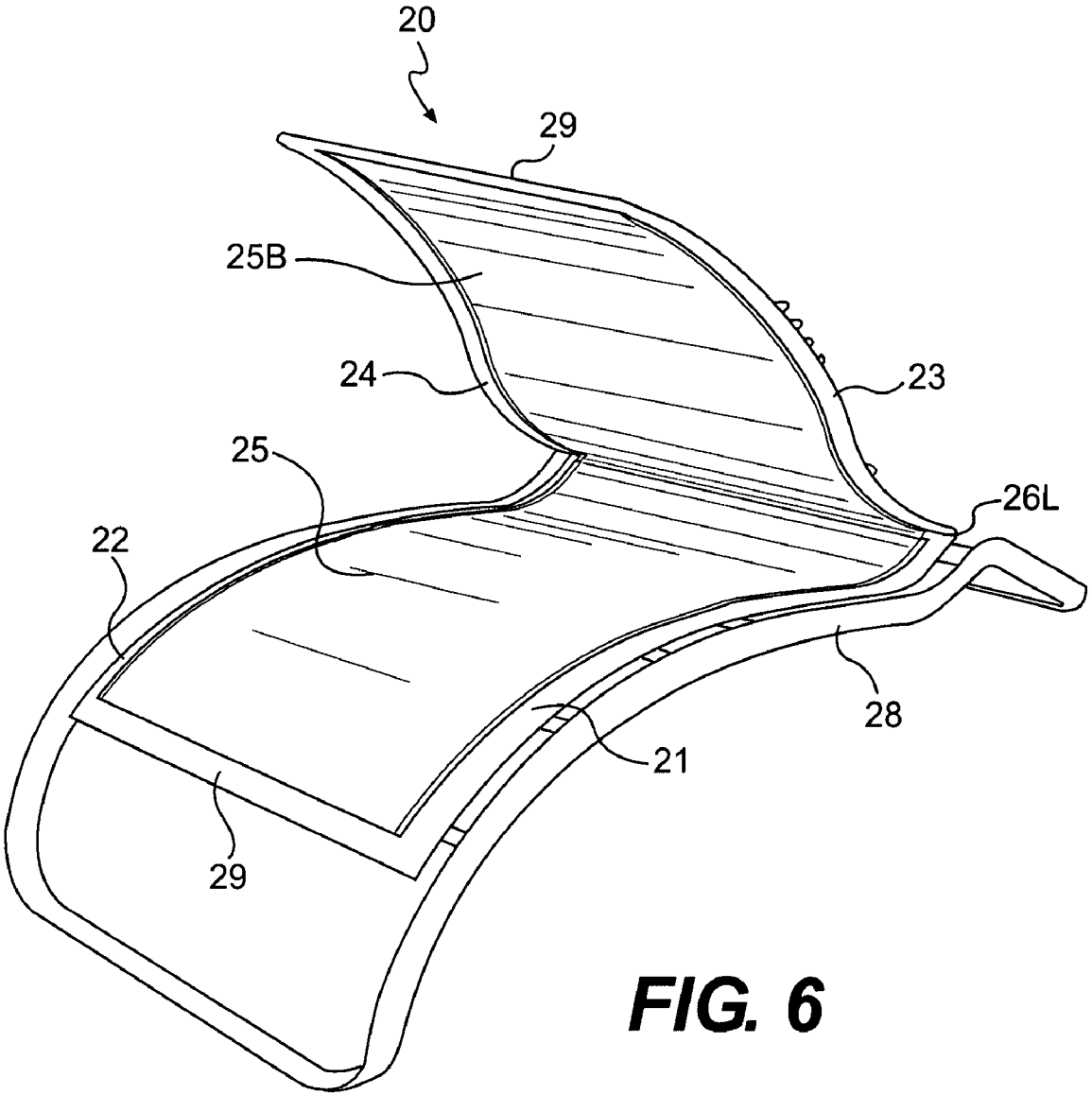
FIG. 6 shows a folding sling chair of the present invention with an adjustable back folded at an acute angle.
Figure 7:
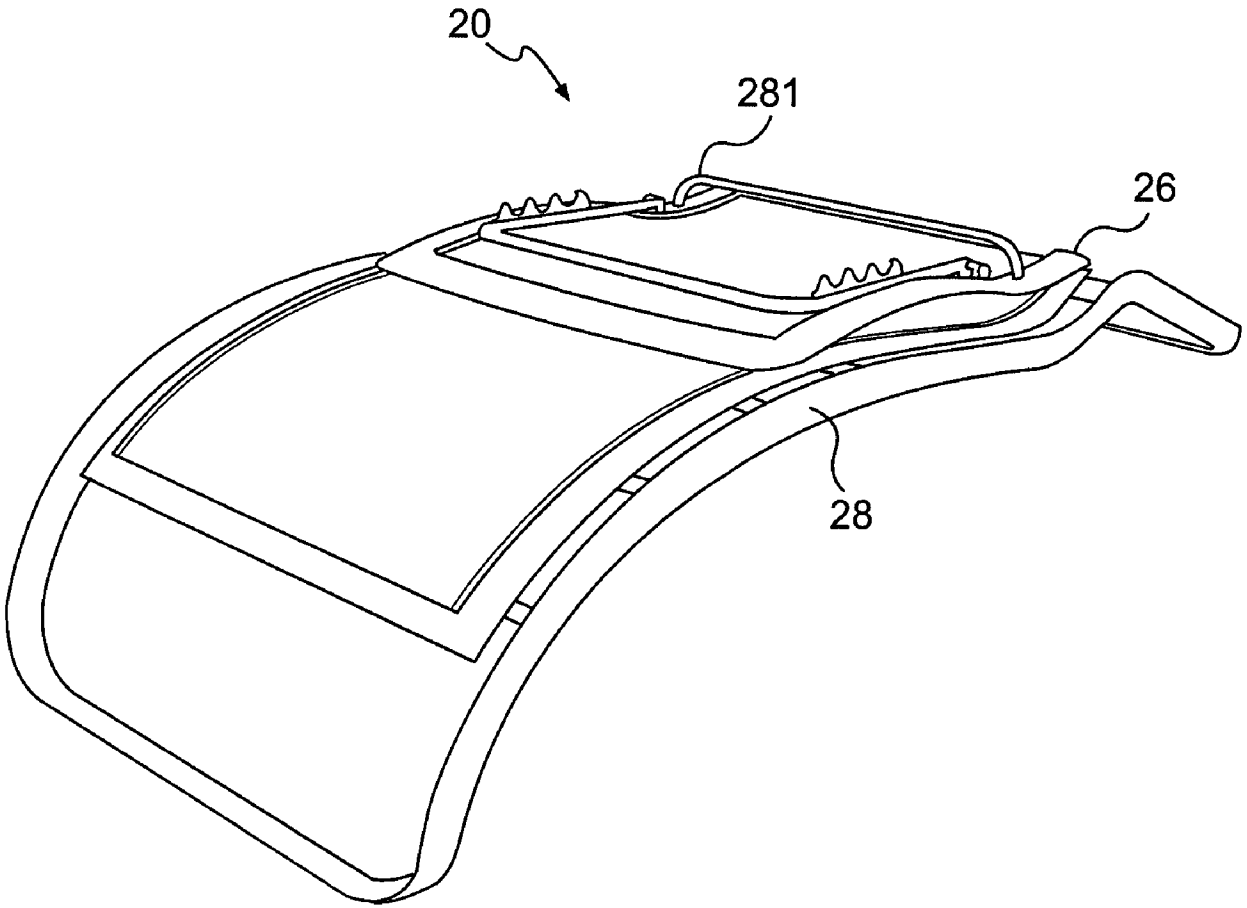
FIG. 7 shows a folding sling chair of the present invention with an adjustable back completely folded at a 180 degree angle.

FIG. 6 depicts folding sling chair 20 where invisible hinges 26 have been pivoted to an acute degree angle. FIG. 7 shows folding sling chair 20 where invisible hinges 26 have been pivoted fully forward, revealing backrest support 281.

As noted above, those skilled in the art will recognize that such a folding sling chair may take a variety of configurations, depending on the application. While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A chair having a folding back, comprising:

at least one pliable sling;

a seat having a tubular right seat side rail and an opposing tubular left seat side rail, each seat side rail attached to and held in spaced relation by at least one seat transverse member, wherein the seat side rails are adapted to support a portion of the sling;

a back having a tubular right back side rail and an opposing tubular left back side rail, each back side rail attached to and held in spaced relation by at least one back transverse member, wherein the back side rails are adapted to support a portion of the sling;

a base assembly connected to the seat side rails and configured to support the chair;

a right invisible hinge interposed between the tubular right seat side rail and the tubular right back side rail and a left invisible hinge interposed between the tubular left seat side rail and the tubular left back side rail, enabling the back to move from a first position to a second position, wherein the right and left invisible hinges are concealed in the first position; and a back support attached to the back and capable of holding the back in the first position and the second position.

2. The chair claim 1, wherein said at least one pliable sling is a single fabric panel.

3. The chair of claim 1, wherein the sling includes at least one right longitudinal sleeve adapted to receive the right seat side rail and the right back side rail, and at least one left longitudinal sleeve adapted to receive the left seat side rail and the left back side rail.

4. A chair having a folding back, comprising:

at least one pliable sling;

a base assembly;

a seat having a tubular right seat side rail and an opposing tubular left seat side rail, each seat side rail attached to and held in spaced relation by at least one seat transverse member integrated into the base assembly, wherein the seat side rails are adapted to support a portion of the sling, and wherein the base assembly connected to the seat side rails and configured to support the chair;

a back having a tubular right back side rail and an opposing tubular left back side rail, each back side rail attached to and held in spaced relation by at least one back transverse member, wherein the back side rails are adapted to support a portion of the sling;

a right invisible hinge interposed between the tubular right seat side rail and the tubular right back side rail and a left invisible hinge interposed between the tubular left seat side rail and the tubular left back side rail, enabling the back to move from a first position to a second position, wherein the right and left invisible hinges are concealed in the first position; and a back support attached to the back and capable of holding the back in the first position and the second position.

5. A folding chair frame, comprising:

at least two tubular left side rails aligned within a first longitudinal plane and pivotally connected by a first invisible hinge mounted internally within the at least two left side rails so as to enable at least one of the left side rails to pivot within the first longitudinal plane relative to at least one non-pivoting left side rail about a first transverse pivot axis defined by the first invisible hinge;

at least two tubular right side rails aligned within a second longitudinal plane and pivotally connected by a second invisible hinge mounted internally within the at least two right side rails so as to enable at least one of the right side rails to pivot within the second longitudinal plane relative to at least one non-pivoting right side rail about a second transverse pivot axis defined by the second invisible hinge;

a first transverse member disposed between and attached to at least one of the non-pivoting left side rails and at least one of the non-pivoting right side rails so as to hold the at least two left side rails in a spaced relation to the at least two right side rails forming a seating zone, a second transverse member disposed between and attached to at least one of the pivoting left side rails and at least one of the pivoting right side rails so as to hold the at least two left side rails in a spaced relation to the at least two right side rails, and so that the first invisible hinge is substantially opposed to the second invisible hinge and the first transverse pivot axis is substantially aligned with the second transverse pivot axis;

a base assembly projecting downwardly from the chair frame and supporting the at least two left side rails and the at least two right side rails; and wherein the at least two left side rails and at least two right side rails are configured so as to be capable of supporting at least one pliable sling disposed in such a manner to form a seat in the seating zone and so that a portion of the pliable sling may pivot about the first and second transverse pivot axes relative to a non-pivoting portion of the pliable sling.

6. The folding chair frame of claim 5, wherein said at least one pliable sling is a single fabric panel.

7. The folding chair frame of claim 5, wherein said pivoting portion of the pliable sling is a backrest.

8. The folding chair frame of claim 5, wherein said pivoting portion of the pliable sling is a footrest.

9. The folding chair frame of claim 5, wherein the at least two left side rails and the at least two right side rails are configured so as to be capable of supporting a single pliable sling having longitudinal sleeves adapted to receive portions of the at least two left side rails and at least two right side rails.

10. The folding chair frame of claim 5, wherein the at least one pliable sling terminates in loops at opposing sides for attaching said sling to said frame, and wherein each of the at least two left side rails and the at least two right side rails have walls defining an open, longitudinal channel therein, said longitudinal channel having a longitudinal neck section defined by at least one of said side rail walls and an interior pocket section therein and having a width greater than said neck in communication with and trapping said fabric sling loop therein;

each said left and right side rails further having an extension section defining a socket therein, wherein said extension section extends beyond said longitudinal channel defined in said side rail and said socket opens to an interior side of its associated said side rail; and each of said first and second transverse members has a first and second end, wherein each one of said first end and said second end of said first and second transverse member is dimensioned and configured to be received in close cooperation by one of said sockets.

11. The folding chair frame of claim 5, wherein the at least one pliable sling has a width and terminates in loops at opposing sides and includes a rod for each loop for attaching said fabric sling to said side rails, wherein each of said at least two left side rails and at least two right side rails have an interior side and a key shaped slot extending longitudinally there along up to its respective invisible hinge, wherein said key shaped slot of each side rail has a first section passing entirely through said side rail and a second section communicating with said first section and located within said side rail wherein said first section of each said slot has a width and said second section of each said slot has a width greater than that of said first section of each said slot and is dimensioned and configured to receive one said rod after said rod is passed though one said loop of said pliable sling; and an extension bearing a socket therein, wherein said extension extends beyond said slot and said socket opens to said interior side of its associated said side rail; and each of said first and second transverse members has a length at least as great in magnitude as said width of said at least one pliable sling, a first end, and a second end, wherein each one of said first end and said second end of the first and second transverse members is dimensioned and configured to be received in close cooperation by one of said sockets.

12. A folding chair frame, comprising:

a base assembly;

at least two tubular left side rails aligned within a first longitudinal plane and pivotally connected by a first invisible hinge mounted internally within the at least two left side rails so as to enable at least one of the left side rails to pivot within the first longitudinal plane relative to at least one non-pivoting left side rail about a first transverse pivot axis defined by the first invisible hinge;

at least two tubular right side rails aligned within a second longitudinal plane and pivotally connected by a second invisible hinge mounted internally within the at least two right side rails so as to enable at least one of the right side rails to pivot within the second longitudinal plane relative to at least one non-pivoting right side rail about a second transverse pivot axis defined by the second invisible hinge;

a first transverse member integrated into the base assembly and disposed between and attached to at least one of the non-pivoting left side rails and at least one of the non-pivoting right side rails so as to hold the at least two left side rails in a spaced relation to the at least two right side rails forming a seating zone, a second transverse member disposed between and attached to at least one of the pivoting left side rails and at least one of the pivoting right side rails so as to hold the at least two left side rails in a spaced relation to the at least two right side rails, and so that the first invisible hinge is substantially opposed to the second invisible hinge and the first transverse pivot axis is substantially aligned with the second transverse pivot axis, and wherein the base assembly projects downwardly from the sling chair frame and supports the at least two left side rails and the at least two right side rails; and wherein the at least two left side rails and at least two right side rails are configured so as to be capable of supporting at least one pliable sling disposed in such a manner to form a seat in the seating zone and so that a portion of the pliable sling may pivot about the first and second transverse pivot axes relative to a non-pivoting portion of the pliable sling.

* * * * *